US007483658B2

(12) United States Patent
Endoh

(10) Patent No.: US 7,483,658 B2
(45) Date of Patent: Jan. 27, 2009

(54) IMAGE FORMING METHOD AND APPARATUS CAPABLE OF ENHANCING TONER MOBILITY

(75) Inventor: Shuuichi Endoh, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 338 days.

(21) Appl. No.: 11/411,033

(22) Filed: Apr. 26, 2006

(65) Prior Publication Data

US 2006/0257173 A1 Nov. 16, 2006

(30) Foreign Application Priority Data

Apr. 28, 2005 (JP) ..... 2005-131430

(51) Int. Cl.
*G03G 15/08* (2006.01)
*G03G 15/04* (2006.01)

(52) U.S. Cl. ..... 399/261; 399/53; 399/119

(58) Field of Classification Search ..... 399/53, 399/119, 120, 258, 261
See application file for complete search history.

(56) References Cited

U.S. PATENT DOCUMENTS

| | | | |
|---|---|---|---|
| 4,788,570 | A | 11/1988 | Ogata et al. |
| 4,873,940 | A | 10/1989 | Ishikawa et al. |
| 5,486,909 | A | 1/1996 | Takenaka et al. |
| 5,489,747 | A | 2/1996 | Takenaka et al. |
| 5,548,383 | A | 8/1996 | Endoh |
| 5,552,870 | A | 9/1996 | Murakami et al. |
| 5,610,693 | A | 3/1997 | Sugiyama et al. |
| 5,625,438 | A | 4/1997 | Sugiyama et al. |
| 5,625,441 | A | 4/1997 | Sugiyama et al. |
| 5,666,625 | A | 9/1997 | Komatsubara et al. |
| 5,689,782 | A | 11/1997 | Murakami et al. |
| 5,708,942 | A | 1/1998 | Sugiyama et al. |
| 5,826,144 | A | 10/1998 | Takenaka et al. |
| 5,845,183 | A | 12/1998 | Sugiyama et al. |
| 6,033,818 | A | 3/2000 | Sugiyama et al. |
| 6,321,049 | B1 | 11/2001 | Endoh |
| 6,643,486 | B1 | 11/2003 | Endoh et al. |
| 6,775,506 | B2 | 8/2004 | Endoh et al. |
| 6,795,674 | B2 | 9/2004 | Endoh et al. |
| 2004/0179866 | A1 * | 9/2004 | Muramatsu et al. ..... 399/258 |

FOREIGN PATENT DOCUMENTS

| | | |
|---|---|---|
| JP | 8-122559 | 5/1996 |
| JP | 2005-62215 | 3/2005 |

* cited by examiner

*Primary Examiner*—David M Gray
*Assistant Examiner*—Joseph S. Wong
(74) *Attorney, Agent, or Firm*—Oblon, Spivak, McClelland, Maier & Neustadt, P.C.

(57) ABSTRACT

An image forming apparatus includes an image carrying member, a charging device for charging the image carrying member, an exposure device for writing a latent image on the image carrying member, a development device for developing the latent image into a visible image, a transfer device for transferring the visible image to a recording medium, a cleaning device for cleaning the image carrying member, and a fixing device for fixing the visible image on the recording medium. The development device includes a development unit, a toner cartridge, and a control mechanism. The toner cartridge supplies toner to the development unit which develops the latent image into the visible image. The control mechanism controls supply and discharge of the toner between the development unit and the toner cartridge. The development device moves at an acceleration of approximately 1 $m/s^2$ in directions of supplying and discharging the toner for a predetermined time.

9 Claims, 12 Drawing Sheets

IMAGE FORMING METHOD AND APPARATUS CAPABLE OF ENHANCING TONER MOBILITY

CROSS REFERENCE TO RELATED APPLICATION

This application claims priority to Japanese patent application no. 2005-131430 filed on Apr. 28, 2005, the entire contents of which are hereby incorporated by reference herein.

BACKGROUND

1. Field of Invention

Exemplary aspects of the present invention relate to an image forming method and apparatus, such as a copier, a facsimile machine, and a printer, for enhancing the mobility of toner in a development device in an image forming operation according to an electrostatic copying process.

2. Description of Related Art

In recent years, automation and colorization in office environments have increasingly progressed. With this trend, in addition to existing opportunities to photocopy a text document, there have been increased opportunities to create a document including images, such as a graph, by using a personal computer, output the document from a printer, and photocopy the document in large numbers for a presentation, for example. Images output by the printer include a solid image, a line image, and a halftone image in many cases. With this tendency, the needs of the market for image quality have been changing. Further, a need for high reliability of images has been also increased.

In a development process, a developer used in an electrophotographic method, such as electrophotography, electrostatic recording, and electrostatic printing, is temporarily adhered to, for example, an image carrying member (typically a photoconductor) on which an electrostatic latent image is formed. Then, in a transfer process, the developer is transferred from the image carrying member onto a transfer medium, such as a transfer sheet.

Thereafter, in a fixing process, the developer is fixed on a recording medium. Related art developers used for developing the electrostatic latent image formed on the image carrying member include a two-component developer including carrier and toner, and a one-component developer not requiring the carrier and thus solely including the toner. The one-component developer is further divided into a one-component developer using a magnetic toner and a one-component developer using a nonmagnetic toner. The two-component developer deteriorates as toner particles adhere to surfaces of the carriers. Further, since only the toner is consumed in the two-component developer, the toner density in the developer decreases. To maintain a toner-to-carrier mixing ratio at a constant value, the development device is increased in size. Meanwhile, the one-component developer contributes to downsizing of the development device and is readily used under a variety of environments, such as a low-temperature and low-humidity environment and a high-temperature and high-humidity environment. Due to such advantages, the one-component developer is becoming the mainstream developer used in developing methods.

As described above, the one-component developer is divided into the magnetic one-component developer using the magnetic toner and the nonmagnetic one-component developer using the nonmagnetic toner. According to a magnetic one-component developer developing method using the magnetic one-component developer, the magnetic toner including a magnetic substance, such as magnetite, is held in a development sleeve which includes a magnetic field generating device, such as a magnet, and the toner is leveled into a thin layer by a layer thickness regulating member to be used in the development process. In recent years, the magnetic one-component developer developing method has been frequently used in small-size printers and the like. Meanwhile, according to a nonmagnetic one-component developer developing method using the nonmagnetic one-component developer, the toner does not have magnetic force. Thus, the toner is supplied to the development sleeve by pressing a toner supply roller, for example, onto the development sleeve, and the toner is electrostatically held thereon. Then, the toner is leveled into a thin layer by the layer thickness regulating member to be used in the development process. The nonmagnetic one-component developer does not include a colored magnetic substance and thus is compatible with the colorization. Further, since the development sleeve does not include a magnet, the nonmagnetic one-component developer developing method contributes to reduction in weight and cost of the development device. In recent years, therefore, the method has been practically used in a small-size full-color printer and the like.

However, the one-component developer developing method is still open to enhancements. According to the two-component developer developing method, the carrier is used as a medium for charging and conveying the toner. Further, the toner and the carrier have been sufficiently mixed in the development device before being conveyed to the development sleeve to be used in the development process. Therefore, the toner can be stably charged and conveyed even after a relatively long-time use. Furthermore, the method can be readily used in a high-speed development device. Meanwhile, the one-component developer developing method does not include the medium for stably charging and conveying the toner, such as the carrier. Therefore, operations of charging and conveying the toner tend to be improperly performed due to the long-time use of the toner and the increase in the operation speed of the development device.

In particular, in the nonmagnetic one-component developer developing method, the toner is conveyed onto the development sleeve and is leveled by the layer thickness regulating member into a thin layer to be used in the development process. In this process, the toner is contacted with the development sleeve and is friction-charged by a friction charging member, such as the layer thickness regulating member, in a substantially short time. Thus, insufficient charging and inverse charging of the toner tend to occur more frequently than in the two-component developer developing method which uses the carrier. Further, in the nonmagnetic one-component developer developing method, the toner is conveyed by at least one toner conveying member, and the thus conveyed toner is used to develop the electrostatic latent image formed on the image carrying member. In this process, the toner layer formed on a surface of the toner conveying member needs to be as thin as possible, and the toner in the thinned layer is applied with pressing force by the layer thickness regulating member. As a result, an external additive applied to surfaces of toner particles is buried deep into the toner particles, and chargeability and mobility of the toner is substantially decreased.

In light of the above, a related art forming apparatus includes, near a toner supply tank and a supply port of a toner hopper, a magnet roller serving as a supply roller and a scraper serving as a layer thickness regulating device. The supply roller is rotated in both forward and inverse directions by a supply roller driving device. When a rotation angle of the supply roller in the forward direction and a rotation angle thereof in the inverse direction formed in a predetermined time period are expressed as A and B, respectively, the supply roller driving device drives the supply roller such that a relationship of A<B is maintained. With this configuration, the mobility of the toner contained in the toner hopper may be prevented from deteriorating. Further, the amount of the toner supplied to a development roller can be kept at a constant value. Accordingly, the image forming apparatus can be reduced in size and prevent insufficient supply of the toner to an image.

There is also a related art development device which includes a development sleeve having a surface formed by a conductive resin layer which is equal in charging polarity to a developer. The conductive resin layer includes at least a joining resin, a conductive fine powder, and a charging control agent. Further, a rotation center X of a mixing member is located under a horizontal plane H which intersects a rotation center of the development sleeve.

However, it is hardly possible to stabilize and maintain chargeability and mobility of the toner of the nonmagnetic one-component developer for a relatively long time period by using the above-described techniques. In addition, there is another problematic phenomenon in which the toner has an inferior mobility when an image forming apparatus using the toner is left unused for a relatively long time period. This is because the toner is rid of air and cohesion of the toner particles is increased.

SUMMARY

In view of the foregoing, this patent specification describes an image forming apparatus. In one example, an image forming apparatus includes an image carrying member, a charging device, an exposure device, a development device, a transfer device, a cleaning device, and a fixing device. The development device includes a development unit, a toner cartridge, and a control mechanism. The charging device is configured to evenly charge a surface of the image carrying member. The exposure device is configured to write a latent image on the surface of the image carrying member. The development unit is configured to develop the latent image into a visible image. The toner cartridge is laterally juxtaposed to and detachable from the development unit and is configured to supply toner to the development unit. The control mechanism is configured to control supply and discharge of the toner between the development unit and the toner cartridge. The development device performs an accelerated movement at an acceleration of approximately 1 meter per second squared in directions of supplying and discharging the toner for a predetermined time period. The transfer device is configured to transfer the visible image to a recording medium directly or via an intermediate transfer member. The cleaning device is configured to clean the toner remaining on the image carrying member. The fixing device is configured to fix the visible image on the recording medium with heat and/or pressure.

This patent specification further describes an image forming method. In one example, an image forming method includes: forming a development device with a development unit, a toner cartridge, and a toner supply and discharge control mechanism; evenly charging a surface of an image carrying member; writing a latent image on the image carrying member; supplying toner from the toner cartridge to the development unit; performing an accelerated movement of the development device at an acceleration of approximately 1 meter per second squared in directions of supplying and discharging the toner for a predetermined time period; causing the development unit to develop the latent image into a visible image; transferring the visible image to a recording medium directly or via an intermediate transfer member; cleaning the toner remaining on the image carrying member; and fixing the visible image on the recording medium with heat and/or pressure.

BRIEF DESCRIPTION OF THE DRAWINGS

A more complete appreciation of the invention and many of the advantages thereof are obtained as the same becomes better understood by reference to the following detailed description when considered in connection with the accompanying drawings, wherein.

DETAILED DESCRIPTION OF THE EXEMPLARY EMBODIMENTS

Figure 1:
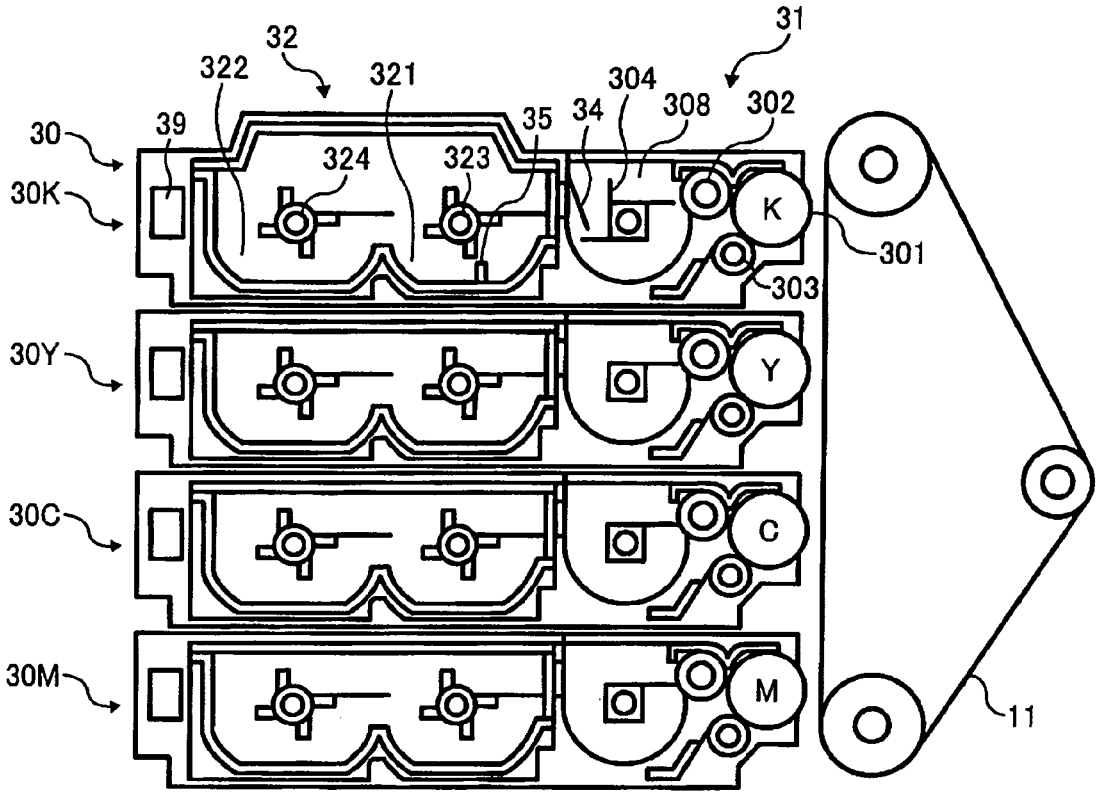
FIG. 1 is a schematic view illustrating a configuration of each of development devices according to an exemplary embodiment of the present invention.

In describing the exemplary embodiments illustrated in the drawings, specific terminology is employed for the purpose of clarity. However, the disclosure of this patent specification is not intended to be limited to the specific terminology so used, and it is to be understood that substitutions for each specific element can include any technical equivalents that operate in a similar manner.

Exemplary aspects of the present invention will now be described with reference to the drawings. A person skilled in the art can readily practice an exemplary embodiment of the present invention by alternating or modifying the present invention. The following descriptions of the present invention are not intended to limit the scope of the invention.

Referring now to the drawings, wherein like reference numerals designate identical or corresponding parts throughout the several views, particularly to FIG. 1, configurations and functions of four development devices 30 according to an exemplary embodiment of the present invention are described.

FIG. 1 is a schematic view illustrating the configurations of the four development devices 30, i.e., development devices 30K, 30Y, 30C, and 30M for four toner colors of K (black), Y (yellow), C (cyan), and M (magenta), respectively. The development devices 30K, 30Y, 30C, and 30M are sequentially placed in this order from the top at the left side of an image forming apparatus 1 (illustrated in FIG. 7). The development devices 30K, 30Y, 30C, and 30M are attached to and detached from the image forming apparatus 1 by opening a left door of the image forming apparatus 1.

The development devices 30K, 30Y, 30C, and 30M are substantially the same in configuration. Therefore, the following description of the development device 30 equally applies to the development devices 30K, 30Y, 30C, and 30M.

The development device 30 includes a development unit 31 and a toner cartridge 32. The development unit 31 develops a latent image formed on a photoconductor belt 11 (i.e., an image carrying member) by using a toner which forms a developer. The toner cartridge 32 supplies the toner to the development unit 31.

The toner cartridge 32 is set in the development device 30, and can be detached together with the development device 30 from the image forming apparatus 1. In an ordinary toner replacement, a front cover of the image forming apparatus 1 and a door behind the front cover are opened, and the toner cartridge 32 can be independently replaced. The toner cartridge 32 is provided with an ID chip 39 which stores information of the toner cartridge 32 used for checking a remaining amount of the toner and the installing of a new toner cartridge.

The development unit 31 includes a development sleeve 301, a supply roller 302, a regulating roller 303, a first conveying paddle 304, and a development hopper 308. The development sleeve 301 faces the photoconductor belt 11, and serves as a developer carrying member which conveys the toner to a development region formed between the development sleeve 301 and the photoconductor belt 11. The supply roller 302 supplies the toner onto the development sleeve 301. The regulating roller 303 serves as a layer thickness regulating member which regulates the amount of the toner carried on the development sleeve 301. The first conveying paddle 304 conveys the toner in the development hopper 308.

The toner cartridge 32 includes a first container 321, a second container 322, a second conveying paddle 323, a third conveying paddle 324, and a rib 35. The first container 321 and the second container 322 contain the toner. The second conveying paddle 323 and the third conveying paddle 324 convey the toner to the development unit 31. The rib 35 projects from a bottom surface of the first container 321 below the rotating second conveying paddle 323.

The developer used in the present example is a one-component developer. As later described, if a two-component developer is used, it is substantially difficult in a developer exchanging operation to separate toner from carrier in the developer in which the toner and the carrier have been mixed with each other. Meanwhile, in the case of the one-component developer, the developer in the toner cartridge 32 and the developer in the development unit 31 are basically the same and thus can be exchanged with each other. Therefore, the one-component developer can be applied to the development device 30 according to an exemplary embodiment of the present invention. In particular, a nonmagnetic one-component developer may be used. In the nonmagnetic one-component developer, an external additive applied to surfaces of toner particles has a substantial influence on the chargeability and the mobility of the toner. In a magnetic one-component developer, the development performance can be controlled by controlling magnetization intensity, which depends on the amount of a magnetic substance. Meanwhile, in the nonmagnetic one-component developer, the development performance is substantially affected by the chargeability and the mobility of the toner, which depends on the external additive. With the nonmagnetic one-component developer used in the development device 30 according to an exemplary embodiment of the present invention, the surface of the toner particles can be kept in a stable state.

In the development device 30, the development unit 31 and the toner cartridge 32 are laterally juxtaposed in a horizontal direction. Further, the development unit 31 and the toner cartridge 32 are formed with communication ports 33 (illustrated in FIGS. 3A to 3D) through which the toner moves between the development unit 31 and the toner cartridge 32. The communication ports 33 of the development unit 31 are provided with a control valve assembly 34.

In the development device 30 of the present exemplary embodiment, the toner passes through the communication ports 33. Through the communication ports 33, the toner is supplied from the toner cartridge 32 to the development unit 31 to compensate for the toner consumed in the development unit 31, and the toner deteriorated in the development unit 31 is discharged from the development unit 31 to the toner cartridge 32. The toner cartridge 32 can be independently exchanged, separately from the development unit 31.

The toner is applied with pressing force by the supply roller 302 and the regulating roller 303 in the development unit 31. Upon receipt of the pressing force, irregularities on the surfaces of the toner particles are eliminated, and the surfaces of the toner particles are smoothed. Thereby, adherence between the toner and the photoconductor belt 11 is increased. This makes cleaning of the photoconductor belt 11 difficult to be performed. As a result, defective cleaning may occur in a low-humidity environment. Further, while transfer performance is enhanced, a white background area may have a fog, which is usually invisible in an image formed by a typical transfer operation. Furthermore, when the toner is applied with the pressing force, the external additive applied to the surfaces of the toner particles is buried into the toner particles. This is because the external additive (later described) is higher in hardness than the toner. As the external additive staying on the surfaces of the toner particles is reduced, the chargeability of the toner changes. In particular, silica used as the external additive has a relatively large surface area and thus is relatively high in chargeability. Therefore, as the amount of the external additive staying on the surfaces of the toner particles is changed due to the burial of the external additive into the toner particles, the amount of the charged toner is substantially changed. The burial of the external additive has another influence, i.e., a reduction in the mobility of the toner. The mobility of the toner indicates the adherence of the toner. If the mobility of the toner is increased, the adherence between the toner and the photoconductor belt 11, for example, is decreased. Similarly, if the adherence between the toner and the development sleeve 301 is decreased, the development performance is enhanced. Conversely, if the amount of the external additive staying on the surfaces of the toner particles is decreased, the mobility of the toner is decreased, and the development performance is deteriorated.

In the development unit 30, through the communication ports 33 used for supplying the toner from the toner cartridge 32 to the development unit 31 to compensate the toner consumed the development unit 31, the toner remaining in the development unit 31 is discharged back to the toner cartridge 32 to be mixed with the undeteriorated toner in the toner cartridge 32. Thereby, an existence ratio of the deteriorated toner is decreased. Thereafter, the mixed toner is again supplied to the development unit 31 through the communication ports 33.

Figure 2:
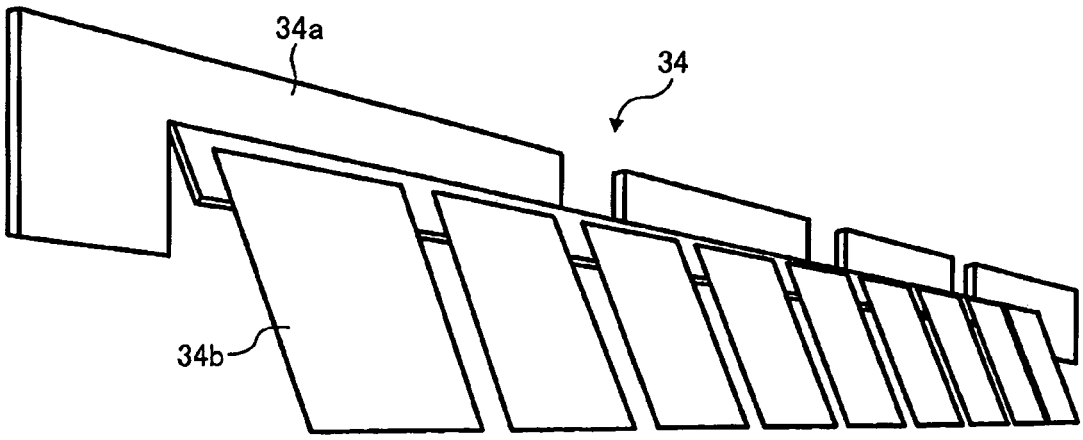
FIG. 2 is a schematic view illustrating a configuration of a control valve assembly provided to the development unit of the development device illustrated in FIG. 1.
Figure 3A:
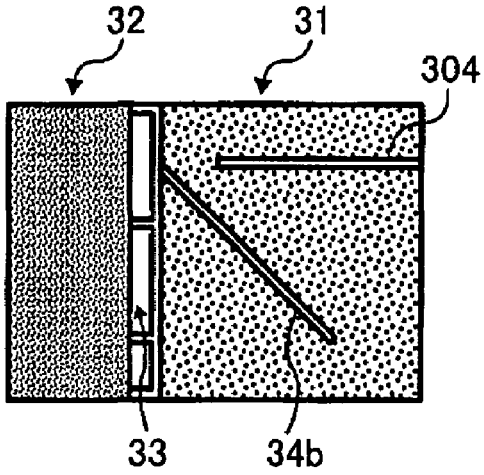
FIGS. 3A to 3D are pattern diagrams illustrating a toner supply process of supplying toner from the toner cartridge to the development unit in the development device illustrated in FIG. 1.
Figure 3B:
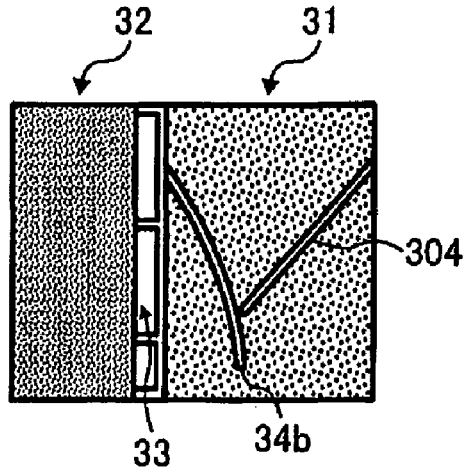
Figure 3C:
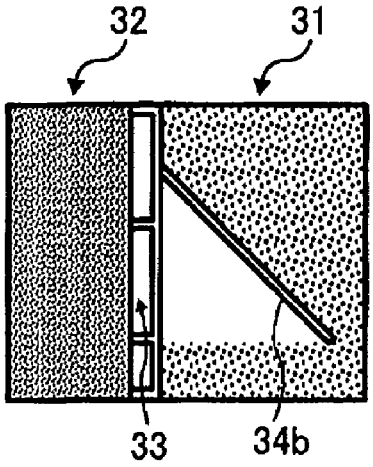
Figure 3D:
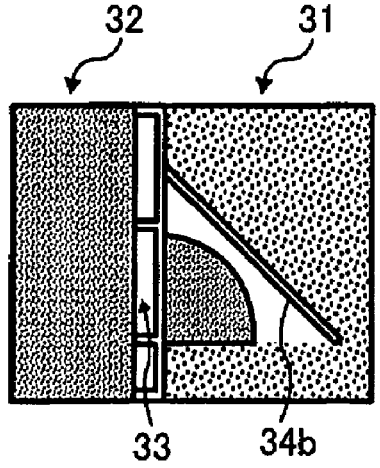

FIG. 2 is a schematic view illustrating a configuration of the control valve assembly 34 provided to the development unit 31 of the development device 30. The control valve assembly 34 includes a support portion 34*a* and control valves 34*b*. The control valves 34*b* are resin films adhered to the support portion 34*a*. The control valve assembly 34 is provided to a wall of the development unit 31 such that the control valves 34*b* correspond to the communication ports 33 of the development unit 31. As illustrated in FIG. 2, the control valves 34*b* are formed into rectangle shapes to correspond to the communication ports 33, and are provided with intervals such that portions of the wall of the development unit 31 not formed with the communication ports 33 do not face the control valves 34*b*. The support portion 34*a* is formed of a stiff metal, such as stainless (SUS), copper (Cu), and aluminum (Al). Meanwhile, the control valves 34*b* are elastic resin films formed of a resin, such as a polypropylene resin, a polyethylene resin, a polyester resin, and a fluorine resin.

The first conveying paddle 304 of the development unit 31 includes a blade film. The first conveying paddle 304 may include a single blade film or a plurality of the blade films. As the first conveying paddle 304 rotates, the toner supplied from the toner cartridge 32 is conveyed by the first conveying paddle 304 to be supplied to the development sleeve 301. The blade film may be formed into a plate shape. Alternatively, the blade film may be formed such that only portions of the blade film in contact with the comb-teeth shaped control valve assembly 34 corresponding to the communication ports 33 are formed into rectangles. In a case in which the first conveying paddle 304 includes the plurality of the blade films, the above-described configurations may be combined.

FIGS. 3A to 3D are pattern diagrams illustrating a toner supply process of supplying the toner from the toner cartridge 32 to the development unit 31. As the first conveying paddle 304 rotates and contacts the control valves 34*b*, the first conveying paddle 304 pushes down the control valves 34*b*. Then, the first conveying paddle 304 passes through the control valves 34*b*, and the elastic control valves 34*b* are swiftly flipped to return to a previous position. In this process, the toner pushed from the toner cartridge 32 is suctioned into the development unit 31 through the communication ports 33. Thereby, the toner is supplied to the development unit 31.

Figure 4A:
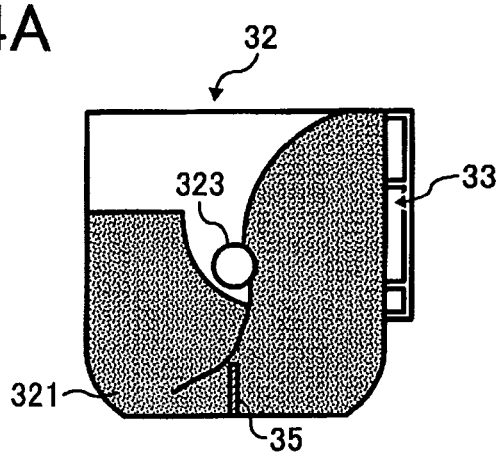
FIGS. 4A to 4C are pattern diagrams illustrating the toner supply process in the toner cartridge illustrated in FIGS. 3A to 3D.
Figure 4B:
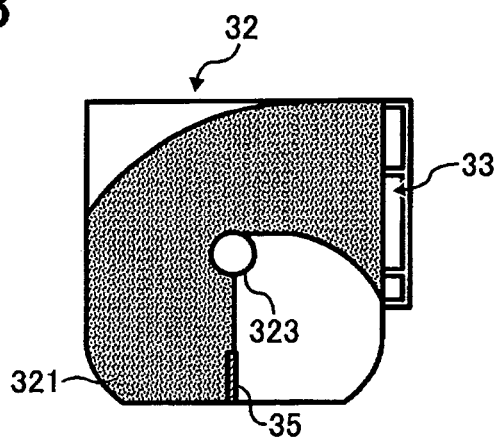
Figure 4C:
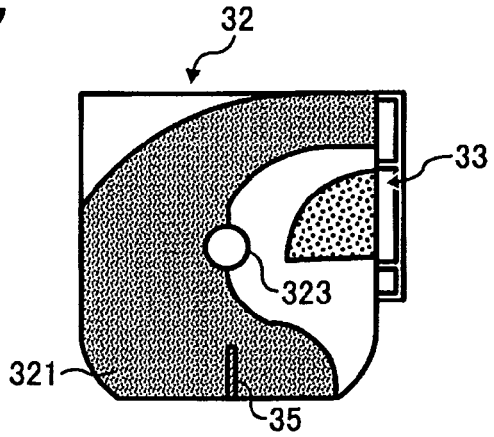

FIGS. 4A to 4C are pattern diagrams illustrating the toner supply process in the toner cartridge 32. In the toner cartridge 32, the third conveying paddle 324 in the second container 322 conveys the toner to the first container 321, and the second conveying paddle 323 conveys the toner to the development unit 31. The second conveying paddle 323 includes a single blade film. As the blade film is rotated, the toner is conveyed to the development unit 31. Further, since the rib 35 is provided in the first container 321, when the blade film contacts the rib 35, the toner is stopped at the rib 35, as illustrated in FIG. 4B. Thereby, an open space not including the toner is formed between the rib 35 and the blade film. Therefore, the open space is formed within the toner for a certain time period, although the mobile toner gradually penetrates and fills the open space. As the blade film continues to rotate, the toner located at an upper position also penetrates the open space, so that the open space formed within the toner disappears.

As the blade film further continues to rotate, the blade film pushes the toner toward the development unit 31. In this state, if the control valves 34*b* of the development unit 31 are not pushed down by the blade film of the first conveying paddle 304, i.e., the control valves 34*b* are in an open state (i.e., at a home position), the toner moves from the toner cartridge 32 to be supplied to the development unit 31 through the communication ports 33.

Then, the toner in the development unit 31 penetrates into a space formed under the control valves 34*b* in the open state. Then, the blade film of the first conveying paddle 304 rotates and pushes the toner in the development unit 31 onto the control valves 34*b* and toward the toner cartridge 32. In this state, if the open space is formed within the toner in the first container 321 by the blade film of the second conveying paddle 323, and if the open space moves to contact the communication ports 33, the toner moves to be discharged from the development unit 31 to the toner cartridge 32 through the communication ports 33.

Movements of the first conveying paddle 304, the second conveying paddle 323, and the third conveying paddle 324, and the movements of the toner between the development unit 31 and the toner cartridge 32 in the development device 30 will now be described in more detail.

Figure 5A:
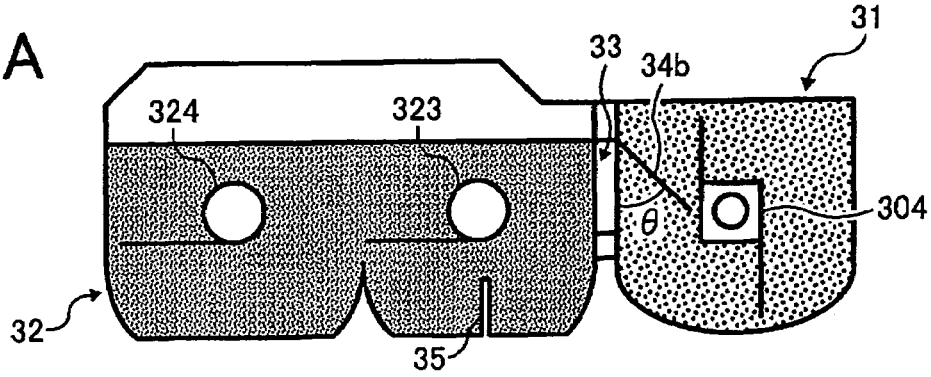
FIGS. 5A to 5P are pattern diagrams illustrating movements of the toner between the toner cartridge and the development unit illustrated in FIGS. 3A to 3D.
Figure 5B:
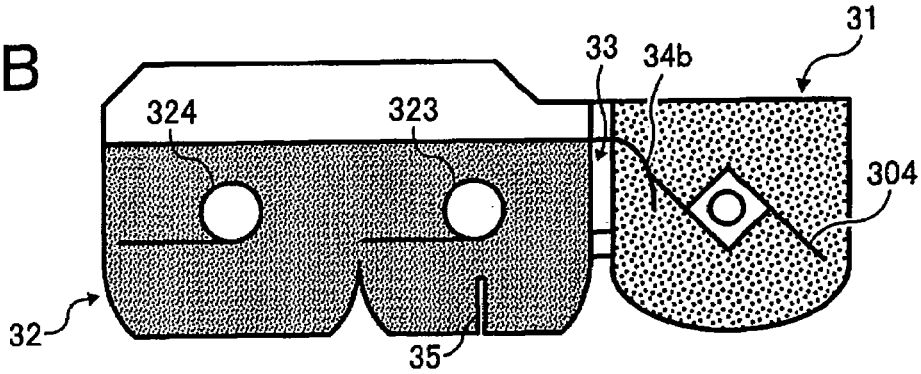
Figure 5C:
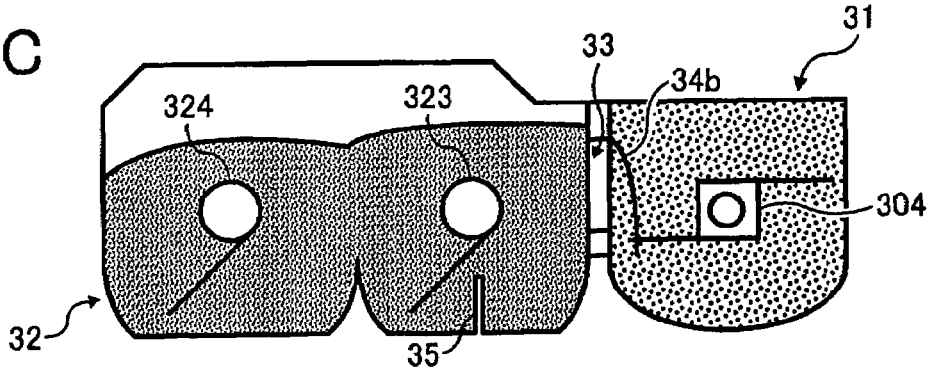
Figure 5D:
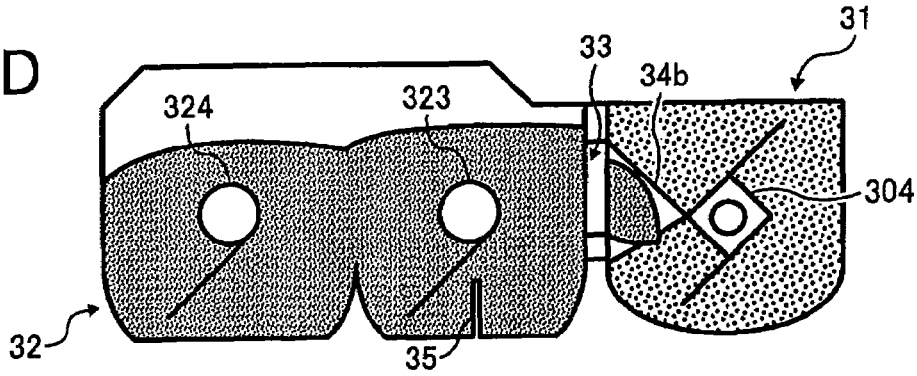
Figure 5E:
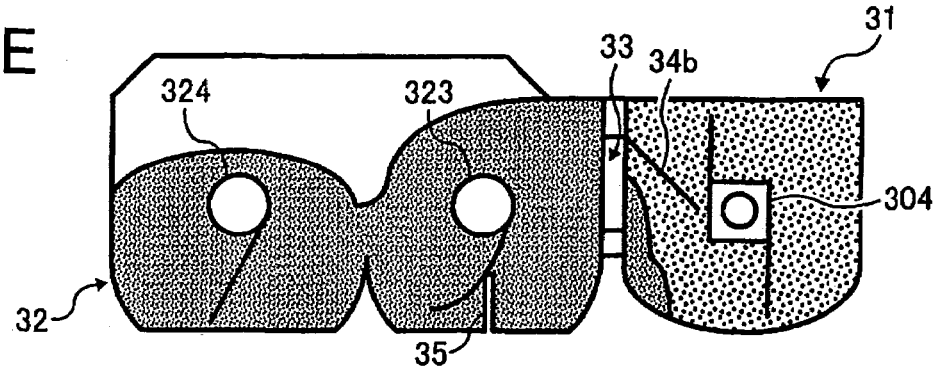
Figure 5F:
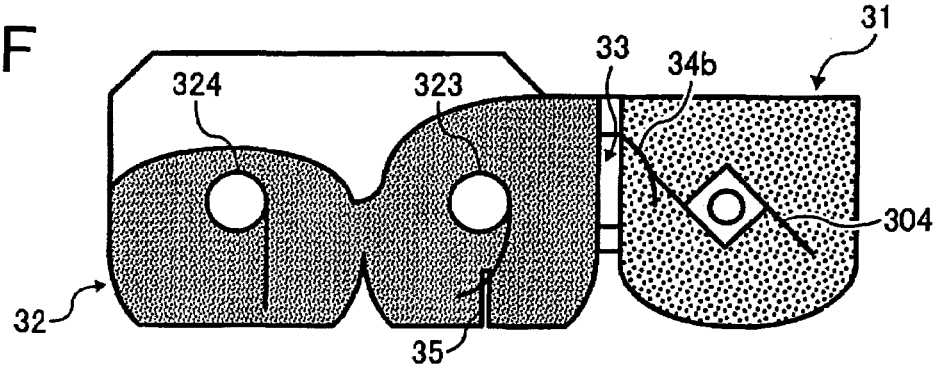
Figure 5G:
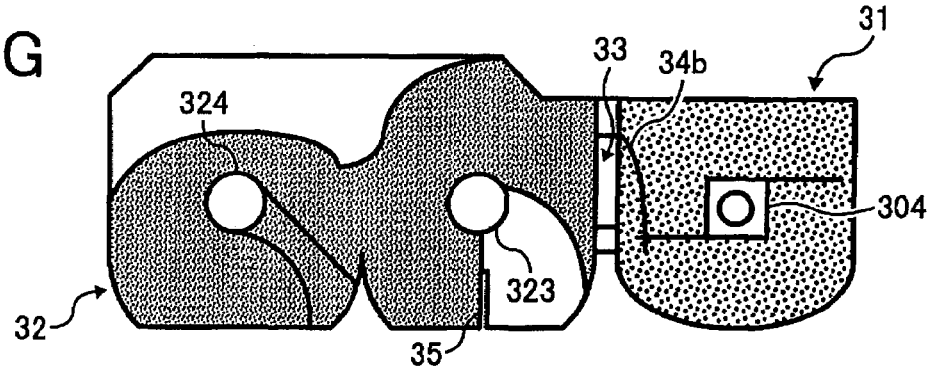
Figure 5H:
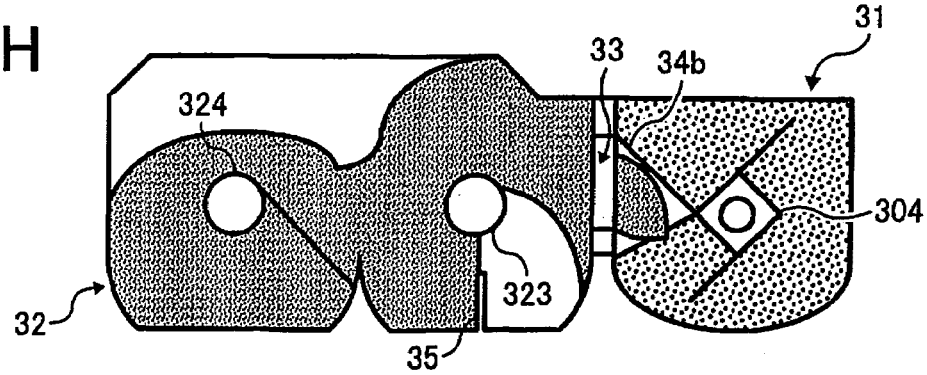
Figure 5I:
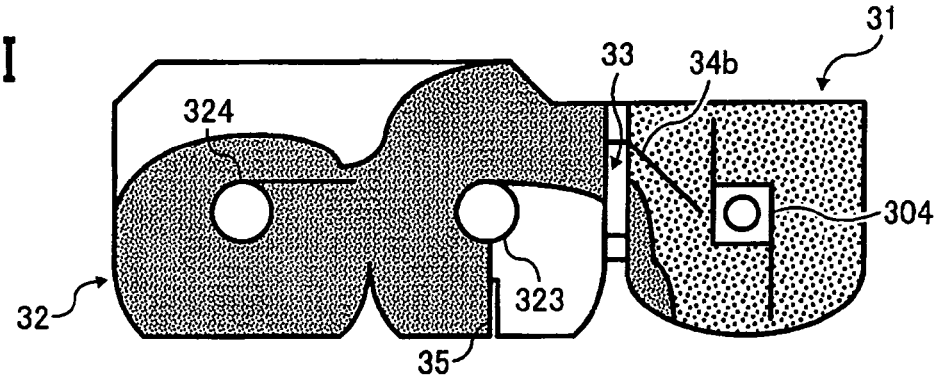
Figure 5J:
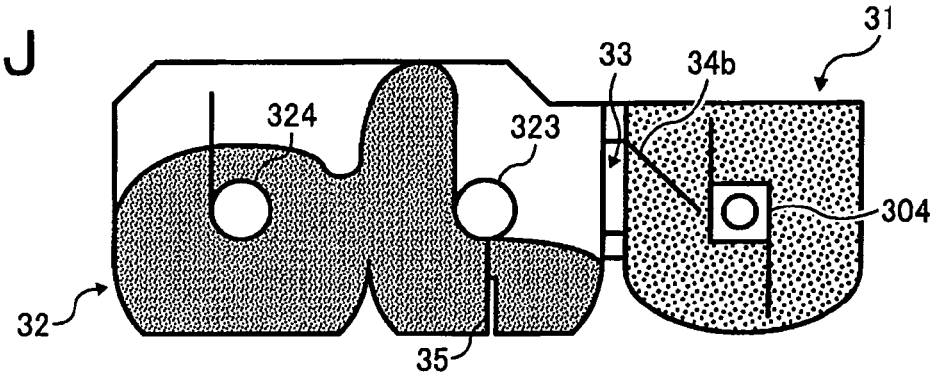
Figure 5K:
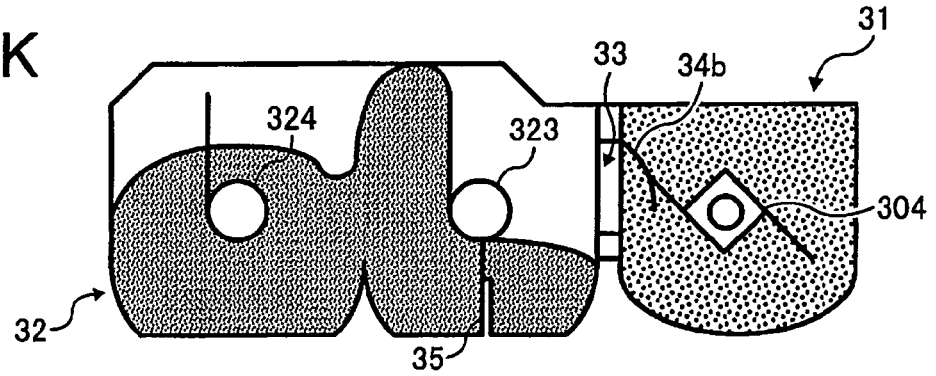
Figure 5L:
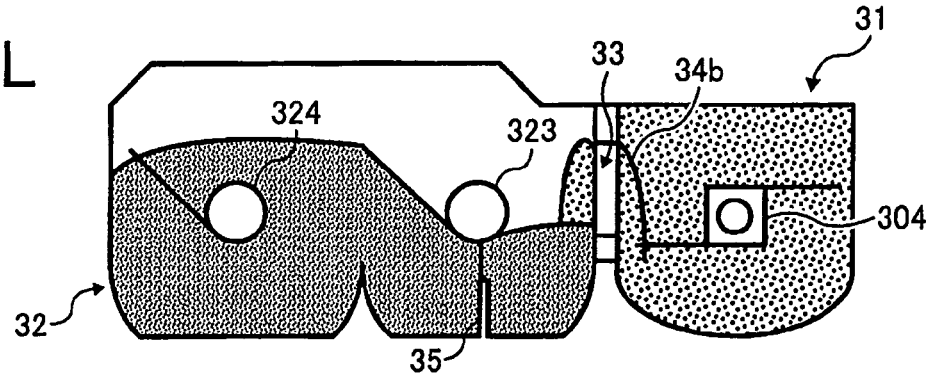
Figure 5M:
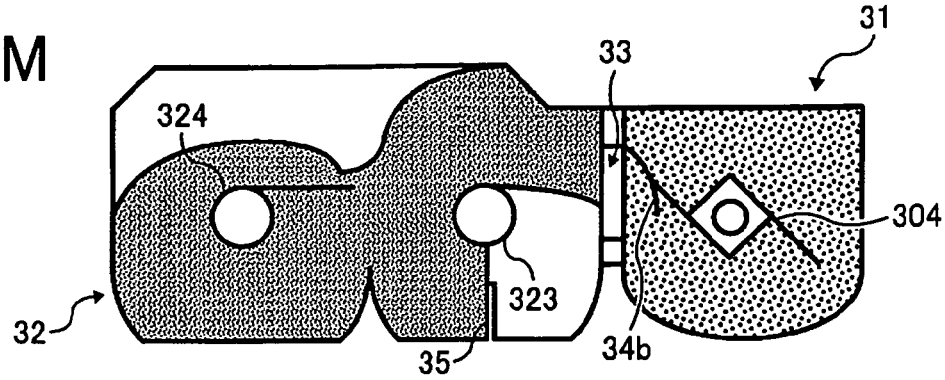
Figure 5N:
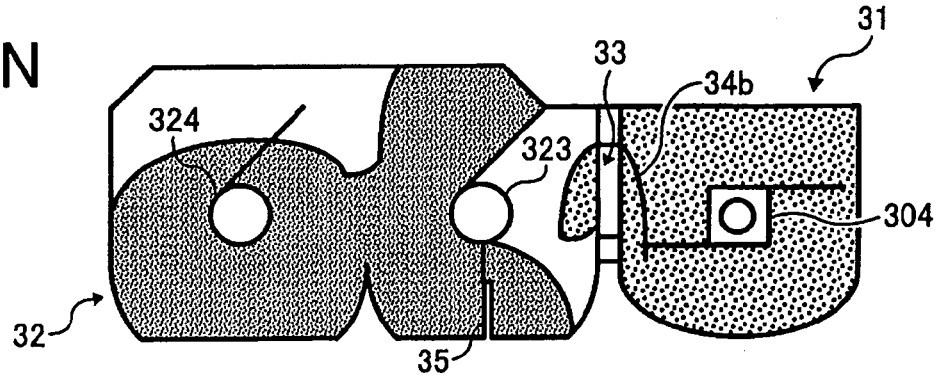
Figure 5O:
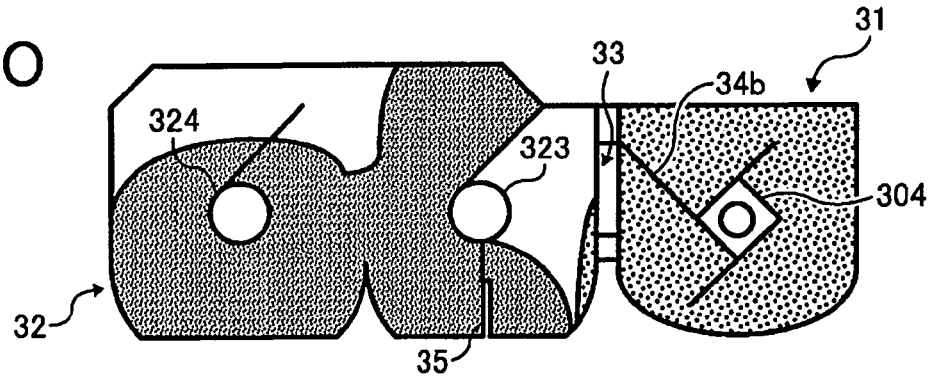
Figure 5P:
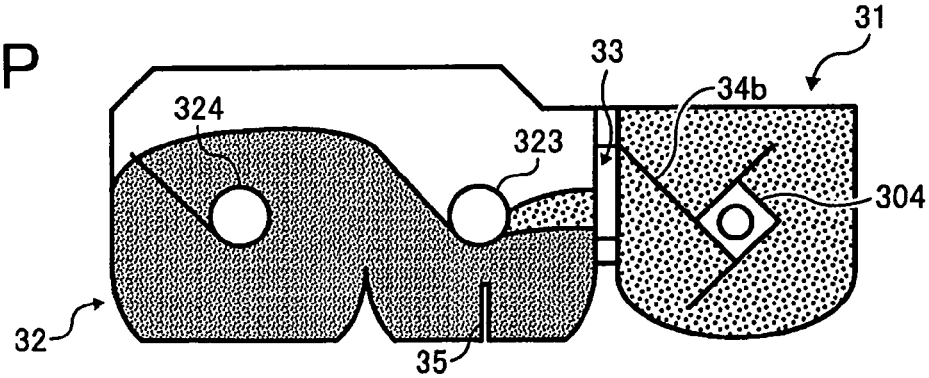

FIGS. 5A to 5P are pattern diagrams illustrating the movements of the toner between the development unit 31 and the toner cartridge 32. In the above pattern diagrams, such components as the development sleeve 301 of the development unit 31 are omitted.

As illustrated in FIG. 5A, the control valves 34*b* provided in the development unit 31 have a predetermined angle of θ (theta) with respect to the wall of the development unit 31 formed with the communication ports 33. The first conveying paddle 304 rotates a plurality of the blade films. Meanwhile, each of the second conveying paddle 323 and the third conveying paddle 324 provided in the toner cartridge 32 rotates a single blade film. In the present example, the first conveying paddle 304 has two blade films (i.e., first and second blade films). However, the number of the blade films is not limited to the above and may be any other plural number. As illustrated in FIG. 5B, in the development unit 31, the first blade film of the first conveying paddle 304 pushes down the control valves 34*b*. In this state, the toner existing between the control valves 34*b* and the communication ports 33 cannot more through the communication ports 33, since the toner cartridge 32 is filled with the toner. Thus, the toner existing between the control valves 34*b* and the communication ports 33 laterally moves back to the development unit 31. Then, as illustrated in FIG. 5C, the first blade film of the first conveying paddle 304 further pushes down the control valves 34*b*, so that there is little clearance between the control valves 34*b* and the communication ports 33 (i.e., the control valves 34*b* are at a working position). Thereafter, as illustrated in FIGS. 5D and 5E, the first blade film of the first conveying paddle 304 releases the control valves 34*b*, and the control valves 34*b* return to an original position to have the original angle (i.e., the control valves 34*b* are at the home position). In this state, a relatively large clearance or space is formed, and the toner moves from the toner cartridge 32 to be supplied to the development unit 31 through the communication ports 33.

Further, as illustrated in FIG. 5F, since the first conveying paddle 304 has the plurality of the blade films, the second blade film of the first conveying paddle 304 pushes down the control valves 34*b* again. In this state, in the toner cartridge 32, the blade film of the second conveying paddle 323 in the first container is in contact with the rib 35. As the first conveying paddle 304 continues to rotate, as illustrated in FIG. 5G, the second blade 30 film of the first conveying paddle 304 further pushes down the control valves 34*b*, so that there is little clearance between the control valves 34*b* and the communication ports 33. In this state, when the blade film of the second conveying paddle 323 rotates to pass through the rib 35, the rib 35 prevents the toner from being conveyed. As a result, an open space is formed within the toner. Further, as illustrated in FIGS. 5H and 5I, the control valves 34*b* are released from the second blade film of the first conveying paddle 304. Thereby, the control valves 34*b* return to the original position to have the original angle, and a relatively large clearance or space is formed. Then, the toner lifted by the blade film of the second conveying paddle 323 moves from the toner cartridge 32 to be supplied to the development unit 31 through the communication ports 33.

However, as illustrated in FIG. 5J, since the first conveying paddle 304 has the plurality of the blade films, the first blade film of the first conveying paddle 304 pushes down the control valves 34*b* again. While the toner exists near the communication ports 33 of the toner cartridge 32 in the foregoing phases described above, the open space within the toner is located to contact the communication ports 33 in the state of FIG. 5J. Therefore, the toner existing near the control valves 34*b* in the development unit 31 does not laterally move back to the development unit 31 but moves from the development unit 31 to be discharged to the toner cartridge 32 through the communication ports 33. Then, as illustrated in FIGS. 5K and 5L, the first blade film of the first conveying paddle 304 further pushes down the control valves 34*b*, and the toner further moves from the development unit 31 to be discharged to the toner cartridge 32.

If the rotation speed of the first conveying paddle 304 is set to be faster than the rotation speed of the second conveying paddle 323, the toner can be moved from the development unit 31 to be discharged to the toner cartridge 32, as illustrated in FIGS. 5M to 5P.

As a series of the above operations are repeated, the toner can be moved between the development unit 31 and the toner cartridge 32 through the communication ports 33.

In the present example, the amount the toner supplied and discharged through the toner movements can be adjusted by controlling rotation numbers of the first conveying paddle 304 in the development unit 31 and the second conveying paddle 323 in the toner cartridge 32. In particular, if the rotation number of the first conveying paddle 304 in the development unit 31 is set to be faster than the rotation number of the second conveying paddle 323 in the toner cartridge 32, the number of contacts of the open space in the toner with the communication ports 33 is reduced, and the number of pushes of the first conveying paddle 304 on the control valves 34*b* is increased. Thereby, the number of toner supplies through the communication ports 33 can be increased.

Alternatively, the amount of the toner supplied and discharged through the toner movements can be adjusted by changing the number of the communication ports 33. That is, the number of the communication ports 33, which may be one or a plural number, is appropriately determined by the speed of an image forming operation performed by the image forming apparatus 1.

Further, the control valves 34*b* provided to correspond to the communication ports 33 can be formed into the comb-teeth pattern and operated such that adjacent ones of the control valves 34*b* are alternately moved. This alternate operation of the control valves 34*b* can be performed by forming each of the blade films of the first conveying paddle 304 in a comb-teeth pattern to alternately correspond to the comb-teeth patterned control valves 34*b*, and alternately operating a pair of the blade films of the first conveying paddle 304 such that the pair of the blade films contact all of the control valves 34*b*. If the control valves 34*b* are thus alternately operated, the toner can be evenly discharged without forming a dead space within the toner in the development unit 31.

Figure 6:
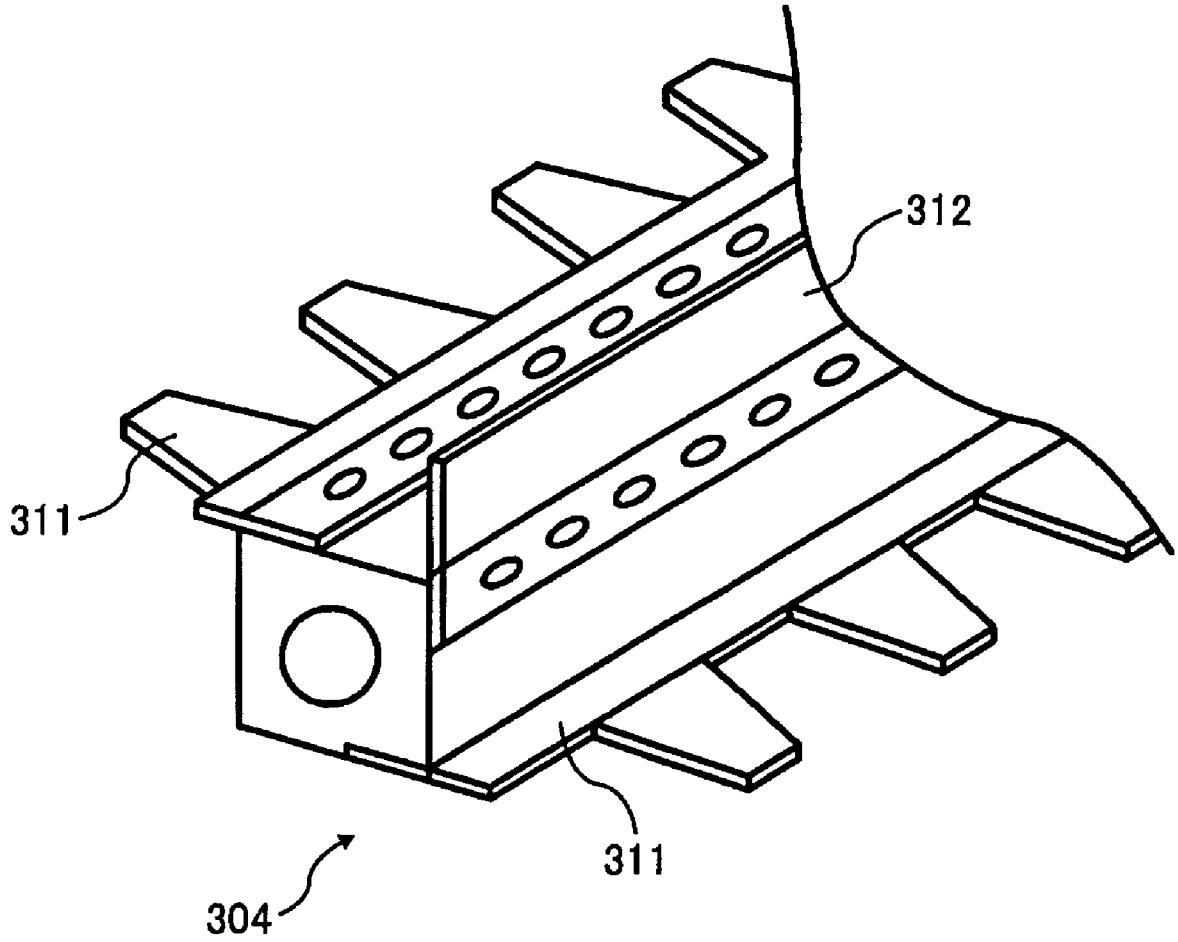
FIG. 6 is a perspective view of the first conveying paddle illustrated in FIGS. 5A to 5P.

FIG. 6 is a perspective view of the first conveying paddle 304 according to an exemplary embodiment of the present invention.

The first conveying paddle 304 includes a pair of two blade films 311 and another blade film 312 attached to a shaft having a quadrangular cross-section. The two blade films 311 are provided to opposite surfaces and extend in opposite directions from each other. Further, each of the blade films 311 is formed into a concave-convex pattern (i.e., a comb-teeth pattern), and the pair of the blade films 311 is formed such that convex portions of one of the blade films 311 are displaced in position from convex portions of the other one of the blade films 311. With this configuration, the adjacent ones of the control valves 34*b* can be alternately driven. The concave-convex portions of the blade films 311 correspond in position to the communication ports 33, and the length of the concave-convex portions is set such that the convex portions can push down the control valves 34*b* provided to the communication ports 33. Further, the concave-convex portions of the blade films 311 are configured such that concave portions do not contact the control valves 34*b*.

Furthermore, each of the convex portions is formed into an approximately trapezoidal shape such that a bottom width is larger than a top width of the convex portion. As the thus configured first conveying paddle 304 rotates, the convex portions of the blade films 311 generate force for laterally moving the toner, and laterally mix the toner in the development unit 31.

Further, as illustrated above, when the first conveying paddle 304 rotates, the convex portions of the blade films 311 push down the control valves 34*b* to cause the toner under the control valves 34*b* to move back to the toner cartridge 32.

Since the first conveying paddle 304 is set to rotate at a faster speed than the second conveying paddle 323, the first conveying paddle 304 can be caused to operate the control valves 34*b* more than once during a time period in which the open space is formed in the toner cartridge 32. Therefore, the toner can be effectively moved back to the toner cartridge 32. When the convex portions pass through the control valves 34*b*, the control valves 34*b* are released from the pressing force and return to the original position due to elasticity. Thereby, the toner above the control valves 34*b* is sent into the development unit 31, and an open space is formed under the control valves 34*b* into which the toner in the toner cartridge 32 is suctioned.

As described above, the convex portions of one of the two blade films 311 are displaced in position from the convex portions of the other one of the two blade films 311. Therefore, the pushing operation and the releasing operation of the control valves 34*b* are alternately performed, i.e., the adjacent ones of the control valves 34*b* are alternately driven. Accordingly, the mobility of the toner in the development unit 31 is enhanced, and circularity between the toner in the development unit 31 and the toner in the toner cartridge 32 can be enhanced.

In the present example, the circularity of the toner and the lateral mixing performance of the toner are enhanced by using the paddle having the pair of two comb-teeth patterned films. However, according to the paddle provided with only the pair of two comb-teeth patterned films, the toner tends to gather near the communication ports 33, and the surface of the toner in the development unit 31 ripples in vertical directions to form peaks and valleys. If a peak is located near the communication ports 33, the toner supply from the toner cartridge 32 is prevented, and the amount of the toner supplied to the development unit 31 is decreased. Further, the toner supplied from the toner cartridge 32 flows at the base of the peak, and mixing uniformity of the toner is slightly deteriorated. To reduce the likelihood or prevent the phenomena, another blade film 312 is added to the first conveying paddle 304. The blade film 312 is formed into a rectangle shape not provided with the concaves and convexes, and the blade film 312 is set to be shorter in length (i.e., height) than each of the convex portions of the comb-teeth patterned blade films 311. Further, the blade film 312 is provided between the two comb-teeth patterned blade films 311 at an angle of approximately 90 degrees with respect to each of the blade films 311. With this configuration, the peak of the toner formed near the communication ports 33 is leveled, and the surface of the toner in the development unit 31 can be substantially leveled out.

As described above, the rectangular blade film 312 is provided to the first conveying paddle 304 at a position between the two comb-teeth patterned blade films 311. With this configuration, the amount of the toner supplied from the toner cartridge 32 and the amount of the toner returned back to the toner cartridge 32 are both stabilized, and the circulatory action of the toner can be sufficiently enhanced. Further, since a local flow of the toner is not generated, uniform mixing performance of the toner in the development unit 31 can be maintained.

The width of each of the control valves 34*b* is set to be larger than the width of the corresponding communication port 33 by a value in a range of from approximately 0 millimeters to approximately 20 millimeters. If the control valve 34*b* is smaller than the communication port 33, the communication port 33 used for supplying the toner is closed by the toner in the development unit 31, and the toner supply to the develop unit 31 becomes difficult to perform. Further, in the normal process of discharging the toner, the toner penetrates into the space formed between the control valves 34*b* and the communication ports 33, and then the thus penetrated toner is discharged. Thereby, a relatively large amount of the toner in the development unit 31 is prevented from being discharged to the toner cartridge 32. However, if the width of the individual control valve 34*b* is reduced, the relatively large amount of the toner is discharged, and the amount of the toner in the development unit 31 is reduced.

In the discharge of the toner, when the first conveying paddle 304 pushes down the control valves 34*b*, the toner penetrated from sides of the control valves 34*b* into the space between the control valves 34*b* and the communication ports 33 is discharged through the communication ports 33. Therefore, conversely, if the width of the individual control valve 34*b* is increased to exceed the width of the corresponding communication port 33, the amount of the toner moving to the communication ports 33 is reduced, and the amount of the discharged toner is reduced. That is, the amount of the interchanged toner is reduced. Further, the toner supplied through the communication ports 33 moves downward from the communication ports 33 and is mixed with the toner staying under the control valves 34*b*. Therefore, if the width of the individual control valve 34*b* is increased, the space for receiving the supplied toner is reduced, and the uniformity of the toner caused by the mixing operation is deteriorated.

In view of the above, the width of the individual control valve 34*b* may be set to be equal to or larger than the width of the corresponding communication port 33 and to be smaller than approximately 20 millimeters. With the width of the control valve 34*b* thus set, the supply and discharge of the toner can be readily controlled, and the uniformity of the toner caused by the mixing operation after the toner supply can be enhanced.

The interval between adjacent ones of the control valves 34*b* is set to be in a range of from approximately 2 millimeters to approximately 20 millimeters. If the interval is smaller than approximately 2 millimeters, the amount of the toner penetrating into the space between the control valves 34*b* and the communication ports 33 is reduced, and the amount of the discharged toner is reduced. Conversely, if the interval exceeds approximately 20 millimeters, the number of the communication ports 33 which can be provided is decreased, and the amount of the supplied toner and the amount of the discharged toner are both reduced.

The length of the individual control valve 34*b* is set to be in a range of from approximately 10 millimeters to approximately 25 millimeters. The length of the control valve 34*b* determines the size of the space formed between the control valves 34*b* and the communication ports 33. Therefore, if the length of the control valve 34*b* is smaller than approximately 10 millimeters, the amount of the discharged toner is reduced, and the interchange of the toner is insufficiently performed. Conversely, if the length of the control valve 34*b* exceeds approximately 25 millimeters, the amount of the discharged toner is increased, and the amount of the toner in the development hopper 308 is reduced.

The angle of the individual control valve 34*b* at the home position is set to be in a range of from approximately 20 degrees to approximately 45 degrees, and the angle of the control valve 34*b* at the working position is set to be in a range of from approximately 0 degrees to approximately 15 degrees. The control valve 34*b* has elasticity. Therefore, the angle of the control valve 34*b* is herein defined as an angle formed between the wall surface of the development unit 31 and a straight line connecting a leading end of the control valve 34*b* and a point of the control valve 34*b* in contact with the wall surface. The angle of the control valve 34*b* determines the size of the space formed between the control valves 34*b* and the communication ports 33. Therefore, if the angle of the control valve 34*b* is smaller than approximately 20 degrees, the amount of the discharged toner is reduced, and the interchange of the toner is insufficiently performed. Conversely, if the angle of the control valve 34*b* exceeds approximately 45 degrees, the amount of the discharged toner is increased, and the amount of the toner in the development hopper 308 is reduced.

Figure 7:
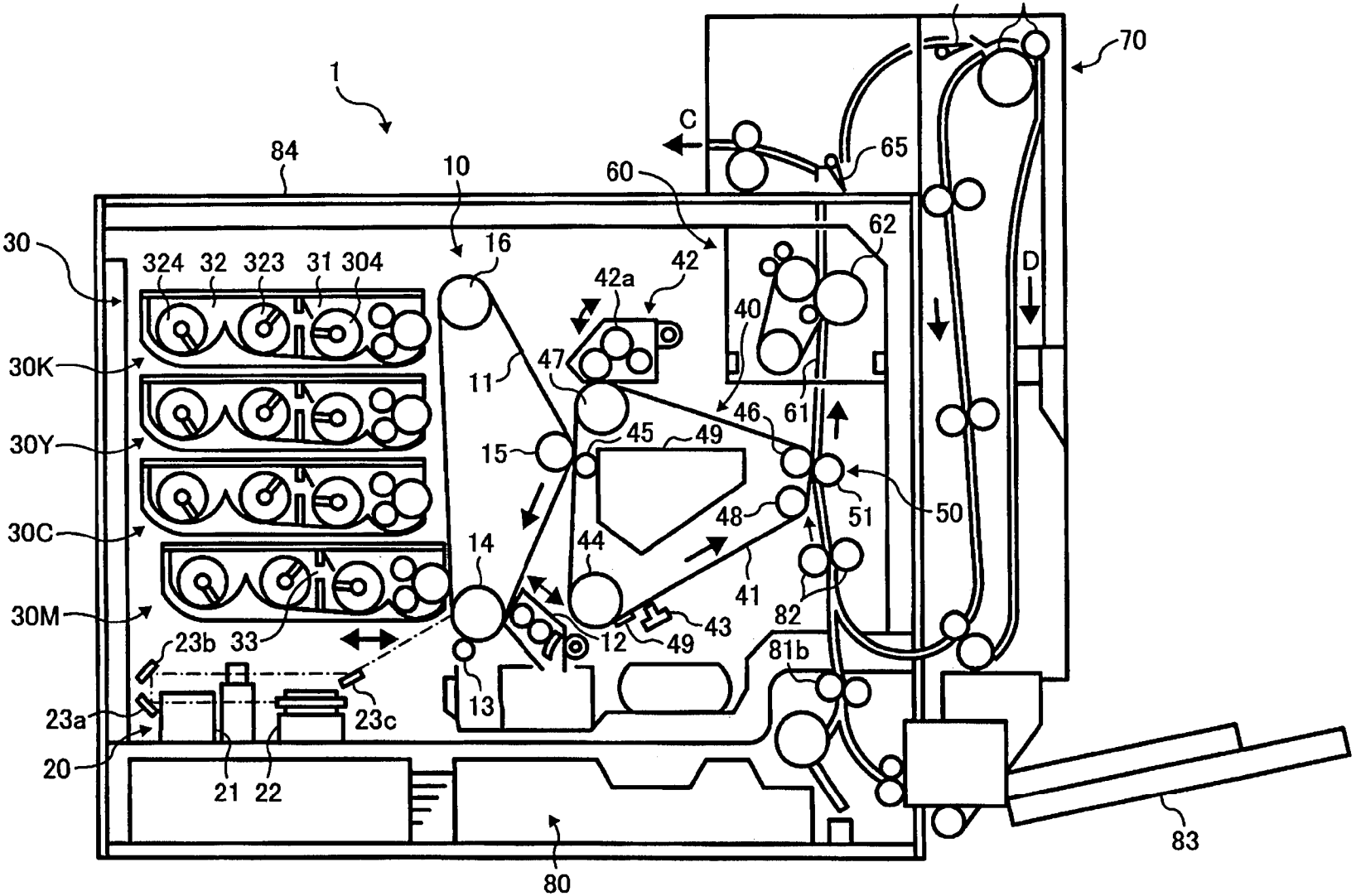
FIG. 7 is a schematic view illustrating a configuration of an image forming apparatus according to an exemplary embodiment of the present invention.

FIG. 7 is a schematic view illustrating a configuration of the image forming apparatus 1 according to an exemplary embodiment of the present invention.

The image forming apparatus 1 includes such units as a photoconductor unit 10, an optical writing unit 20, a development device 30, an intermediate transfer unit 40, a second transfer unit 50, a fixing unit 60, and a duplex sheet reversing unit 70. The image forming apparatus 1 forms a full-color image including four colors by sequentially developing single-color images of black (K), cyan (C), magenta (M), and yellow (Y) on the photoconductor belt 11 into respective visible images, and then superimposing the thus developed visible images. The photoconductor belt 11 is surrounded by such devices as a photoconductor cleaning device 12, a charging roller 13, the plurality of the development devices 30 (i.e., the development devices 30K, 30Y, 30C, and 30M), an intermediate transfer belt 41 of the intermediate transfer unit 40, for example. Further, the photoconductor belt 11 is extended with tension between a drive roller 14, a driven roller 15 facing the intermediate transfer belt 41, and a tension roller 16, and is rotated by a drive motor (not illustrated). The optical writing unit 20 converts color image data into optical signals, and performs optical writing in accordance with the respective color image data to form electrostatic latent images on the photoconductor belt 11. The optical writing unit 20 includes such components as a semiconductor laser 21, a polygon mirror 22, and three reflecting mirrors 23*a*, 23*b*, and 23*c*.

As described above, the development devices 30, i.e., the development devices 30K, 30Y, 30C, and 30M, which contain the black toner, the yellow toner, the cyan toner, and the magenta toner, respectively, are sequentially placed in this order from the top in the image forming apparatus 1. In the present example, each of the development devices 30 includes a contact-separation mechanism for moving the development device 30 in horizontal directions in the drawing such that the development device 30 contacts and separates from the photoconductor belt 11.

In each of the development devices 30, the toner is charged to a predetermined polarity, and the development sleeve 301 is applied with a development bias voltage by a development bias power supply (not illustrated) such that the development sleeve 301 is biased to a predetermined potential with respect to the photoconductor belt 11. The development device 30 is moved toward the photoconductor belt 11 by a driving force of the contact-separation mechanism, when an electromagnetic clutch (not illustrated) for transmitting the driving force from a motor (not illustrated) to the development device 30 is turned on. In the development process, a selected one of the development devices 30 moves to contact the photoconductor belt 11. If the electromagnetic clutch is turned off to stop the transmission of the driving force, the development device 30 in contact with the photoconductor belt 11 moves to separate from the photoconductor belt 11.

In the image forming apparatus 1 in a stand-by state, the development devices 30K, 30Y, 30C, and 30M are set at positions separate from the photoconductor belt 11. When an image forming operation starts, the optical writing using a laser beam and formation of the electrostatic latent images in accordance with the color image data start. Thereby, electrostatic latent images of the respective colors, i.e., black, yellow, cyan, and magenta are formed. For example, in developing a black electrostatic latent image with the black toner in the development device 30K, the rotation of the development sleeve 301 is started before a leading edge of the black electrostatic latent image reaches a black toner developing position. Then, the developing operation of the black electrostatic latent image continues. When a trailing edge of the black electrostatic latent image has passed the black toner developing position, the development device 30K separates from the photoconductor belt 11. Then, to prepare for the development of a next color, the development device 30 of the next color moves to contact the photoconductor belt 11. The above-described movement is complete at least before a leading edge of an electrostatic latent image in accordance with the next color image data reaches its development position.

The intermediate transfer unit 40 includes such components as the intermediate transfer belt 41, a belt cleaning device 42, and a position detection sensor 43. The intermediate transfer belt 41 is extended with tension between a drive roller 44, a first transfer roller 45, a driven roller 46 facing a second transfer roller 51, a driven roller 47 facing the belt cleaning device 42, and a tension roller 48. Drive control of the intermediate transfer belt 41 is performed by a drive motor (not illustrated). The intermediate transfer belt 41 is formed with a plurality of position detection marks in a non-image forming region at an edge portion of the intermediate transfer belt 41. The position detection sensor 43 detects any one of the plurality of position detection marks, and the image forming operation starts upon detection of the position detection mark. The belt cleaning device 42 includes such devices as a cleaning brush 42*a* and a contact-separation mechanism. During a transfer operation of transferring an image of any one of the four colors to the intermediate transfer belt 41, the contact-separation mechanism of the belt cleaning device 42 keeps the cleaning brush 42*a* separate from the intermediate transfer belt 41.

The second transfer unit 50 includes such devices as the second transfer roller 51, and a contact-separation mechanism including a clutch or the like for moving the second transfer roller 51 to contact and separate from the intermediate transfer belt 41. To match the timing of arrival of a transfer sheet to a second transfer position, the second transfer roller 51 rotates around a rotation axis of the contact-separation mechanism of the second transfer unit 50. Thereby, the second transfer roller 51 and the driven roller 46 apply constant pressure to cause the transfer sheet and the intermediate transfer belt 41 to contact with each other. A positioning member (not illustrated) included in the intermediate transfer unit 40 maintains accuracy of a parallel positional relationship between the driven roller 46 and the second transfer roller 51. Further, a positioning roller (not illustrated) provided to the second transfer roller 51 controls contact pressure of the second transfer roller 51 to the intermediate transfer belt 41 at a constant value. Concurrently with the contact of the second transfer roller 51 with the intermediate transfer belt 41, the second transfer roller 51 is applied with a transfer bias voltage of an opposite polarity to the polarity of the toner. Thereby, the toner images superimposed on the intermediate transfer belt 41 are transferred to the transfer sheet at one time.

Meanwhile, before the start of the image forming operation, the transfer sheet has been sent from either one of a sheet feed cassette 80 and a manual sheet feed cassette 83 and stands by at a nip formed between a pair of registration rollers 82. When a leading edge of the four-color superimposed toner image on the intermediate transfer belt 41 reaches a position facing the second transfer roller 51, the pair of registration rollers 82 are driven to position the transfer sheet to the toner image such that a leading edge of the transfer sheet is aligned with the leading edge of the toner image. Then, the transfer sheet, in contact with the toner image on the intermediate transfer belt 41, passes through the second transfer position. During this course, the transfer sheet is charged with the transfer bias voltage by the second transfer roller 51, and most of the toner image is transferred to the transfer sheet. Then, the transfer sheet, to which the four-color superimposed toner image has been transferred at one time from the intermediate transfer belt 41, is conveyed to the fixing unit 60, and the toner image is fused and fixed on the transfer sheet at a nip formed between a pressing roller 62 and a fixing belt 61 which is controlled to have a predetermined temperature. Thereafter, the transfer sheet is sent out of the image forming apparatus 1 and stacked face down on a sheet discharge tray 84. Thereby, a full-color copy is obtained.

In a duplex printing operation, the transfer sheet, which has passed through the fixing unit 60, is sent to the duplex sheet reversing unit 70 by a duplex switching claw 65. In the duplex sheet reversing unit 70, the transfer sheet is first introduced in a direction indicated by an arrow D by a reverse switching claw 71. Then, the trailing edge of the transfer sheet passes through the reverse switching claw 71, and a pair of reverse rollers 72 are stopped to stop the transfer sheet. Thereafter, the pair of reverse rollers 72 start rotating in a reverse direction after a certain time interval, and a switch-back operation of the transfer sheet starts. In this process, the reverse switching claw 71 is switched into a direction of sending the transfer sheet back to the pair of registration rollers 82. The transfer sheet thus sent back to the pair of registration rollers 82 stands by at the nip of the pair of registration rollers 82, with the transfer sheet reversed. Then, the pair of registration rollers 82 are driven at a predetermined timing, and the transfer sheet is sent to the second transfer position. At the position, another four-color superimposed toner image is transferred at one time from the intermediate transfer belt 41 to the transfer sheet, and the toner image is fused and fixed on the transfer sheet at the fixing unit 60. Then, the transfer sheet is sent out of the image forming apparatus 1.

Meanwhile, after the first transfer operation has completed, the surface of the photoconductor belt 11 is cleaned by the photoconductor cleaning device 12. The surface of the photoconductor belt 11 may be uniformly discharged by a discharge lamp (not illustrated) or the like to promote the cleaning operation. On the other hand, the surface of the intermediate transfer belt 41, from which the toner image has been transferred to the transfer sheet, is cleaned as the contact-separation mechanism of the belt cleaning device 42 causes the cleaning brush 42*a* of the belt cleaning device 42 to be pressed onto the intermediate transfer belt 41. The toner removed from the intermediate transfer belt 41 in the cleaning operation is stored in a waste toner tank 49.

The development device 30 will now be described in more detail. As described above, the development device 30 includes the development unit 31 and the toner cartridge 32 which contains the toner. The development unit 31 includes the development sleeve 301 which rotates while carrying the toner on the surface thereof so that the electrostatic latent images formed on the surface of the photoconductor belt 11 are developed with the toner. The development unit 31 further includes the first conveying paddle 304 which rotates to lift and mix the toner. The development device 30 is thus divided into the two sections, since the development unit 31 is durable for a time period during which the toner cartridge 32 needs to be replaced more than once.

Figure 8:
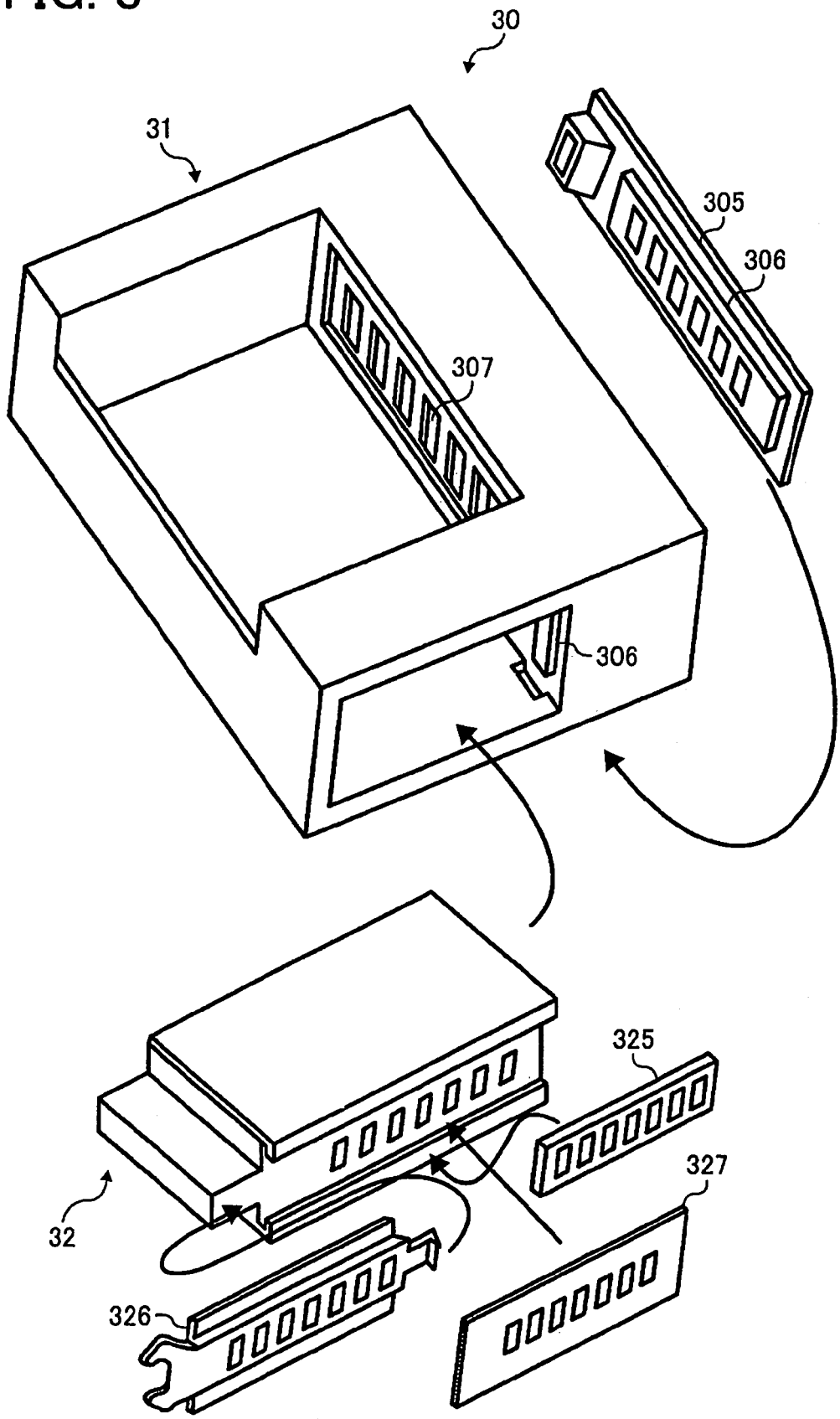
FIG. 8 is a schematic view illustrating configurations of the communication ports formed on the development device and on the toner cartridge illustrated in FIGS. 5A to 5P.

FIG. 8 is a schematic exploded view illustrating a configuration of the communication ports 33 in the development device 30. The figure illustrates structures of the communication ports 33 formed on the development unit 31 and the communication ports 33 formed on the toner cartridge 32. A sliding shutter 305 is provided to the outside of a housing portion of the development unit 31. The sliding shutter 305 is adhered with an elastic member 306 to reduce the likelihood or prevent a clearance from being formed between the development unit 31 and the toner cartridge 32 when the toner cartridge 32 is installed in the development device 30. The communication ports 33 of the development unit 31 are opened and closed by sliding the sliding shutter 305. Meanwhile, the toner cartridge 32 includes an elastic member 325 which has windows 307 corresponding to the communication ports 33 formed on a housing portion of the toner cartridge 32. The toner cartridge 32 further includes a sliding shutter 326 which reduces the likelihood or prevents the toner from being dripped from the communication ports 33 and which opens the communication ports 33 to allow the toner supply, and a fixing seal 327 which fixes the elastic member 325 and the sliding shutter 326 to the housing portion of the toner cartridge 32.

The toner cartridge 32 is installed in the development device 30, and the sliding shutter 305 of the development unit 31 and the sliding shutter 326 of the toner cartridge 32 are slid open to allow the communication ports 33 to let the toner pass therethrough.

The development unit 31 is formed with the plurality of the communication ports 33, and the sliding shutter 305 adhered with the elastic member 306 is provided between the development unit 31 and the toner cartridge 32. The communication ports 33 formed on the housing portion of the development unit 31 are opened and closed by moving the sliding shutter 305. When the development unit 31 is not attached with the toner cartridge 32, and when the development unit 31 is not installed in the image forming apparatus 1, for example, the toner may be prevented from being dropped from the development unit 31, if the communication ports 33 are closed with the sliding shutter 305.

Similarly, to reduce the likelihood or prevent the toner from being dropped from the toner cartridge 32 when the toner cartridge 32 is not attached with the development unit 31, and when the toner cartridge 32 is not installed in the image forming apparatus 1, for example, the toner cartridge 32 is provided with the sliding shutter 326 for closing the communication ports 33. The toner cartridge 32 is thus provided with the elastic member 325, the sliding shutter 326, and the fixing seal 327. The elastic member 325 may be formed of a foamed material formed of a resin, such as a urethane resin and a silicone resin.

As illustrated in FIG. 8, the sliding shutters 305 and 326 are formed with windows corresponding to the communication ports 33 of the development unit 31 and the communication ports 33 of the toner cartridge 32, respectively. To close the communication ports 33, windowless areas of the sliding shutters 305 and 326 are used. Conversely, to open the communication ports 33, the sliding shutters 305 and 326 are moved to align the windows to the communication ports 33 so that the communication ports 33 of the development unit 31 communicates with the communication ports 33 of the toner cartridge 32.

In the development device 30 of the image forming apparatus 1, the first conveying paddle 304 provided in the development unit 31 mixes and conveys the toner to the supply roller 302. Then, the supply roller 302 slidingly contacts the development sleeve 301, and also slidingly contacts the toner to charge the toner by friction charging. The thus charged toner is adhered to the development sleeve 301 due to image force, and is conveyed by the development sleeve 301. Thereafter, the amount of the toner conveyed to the development region is controlled by the regulating roller 303. Then, a part of a thin toner layer formed on the development sleeve 301 is moved onto the photoconductor belt 11 by the development bias voltage in the development region.

In the above process, the toner rubbed to the development sleeve 301 by the supply roller 302 receives relatively large pressing force. Thereby, irregularities on the surfaces of the toner particles are eliminated, and the toner particles are rounded. As a result, the adherence of the toner is increased. Further, the external additive staying on the surfaces of the toner particles is buried into the toner particles due to the pressing force, and the mobility of the toner is decreased. Furthermore, adjustment of the amount of the charged toner using the external additive becomes difficult to perform, and the amount of the charged toner is changed. Due to the above-described factors, the development performance of the toner is deteriorated, and transfer performance and cleaning performance are also deteriorated.

Accordingly, deteriorated toner accumulates in the development hopper 308. Further, the toner is consumed in the development operations, and the amount of the toner in the development unit 31 is decreased. To address the above situations, the toner is supplied from the toner cartridge 32 to the development unit 31 through the communication ports 33. In the toner cartridge 32, the second conveying paddle 323 and the third conveying paddle 324 are provided in the first container 321 and the second container 322, respectively, such that the leading edges of the second conveying paddle 323 and the third conveying paddle 324 are in sliding contact with an inner wall of the toner cartridge 32. As one of the second conveying paddle 323 and the third conveying paddle 324 rotates, the toner is pushed toward the development unit 31 to be supplied into the development unit 31 through the communication ports 33.

Further, through the communication ports 33, the toner in the development unit 31 is discharged to the toner cartridge 32 to be mixed with the toner contained in the toner cartridge 32. The toner cartridge 32 contains a relatively large amount of unused toner, and the unused toner is mixed with the toner deteriorated in and discharged from the development unit 31. Through the mixing operation of the toner, a relatively large amount of the external additive staying on the surfaces of toner particles forming the unused toner are redistributed to the deteriorated toner. As a result, the condition of the deteriorated toner approaches the condition of the original unused toner in terms of the charging amount and the mobility of the toner. That is, the toner discharged from the development unit 31 to the first container 321 is convoyed by the second conveying paddle 323 to the second container 322, and then the toner is conveyed back to the first container 321 by the third conveying paddle 324. The redistribution of the external additive to the deteriorated toner is performed in this process.

The toner thus approached to the state of the original unused toner is then supplied again to the development unit 31 from the first container 321 of the toner cartridge 32. A thin toner layer is formed by the mixture of the unused toner and the toner approached to the state of the original unused toner, and a toner image is formed from the thus formed thin toner layer. Thereby, images of relatively high quality can be obtained for a relatively long period of time.

If the toner used in the development unit 31 contains air, the toner moves smoothly. However, if the toner has been kept in a stationary state and most of the air has escaped from the toner, the toner becomes less mobile due to the cohesion between the toner particles. If the toner that has become less mobile after having been kept in the stationary state is applied with such force that breaks the binding between the toner particles, air spaces are formed between the toner particles, and thus the toner can recover the mobility.

To recover the mobility of the toner kept in the stationary state as described above, the development device 30 according to the present exemplary embodiment is caused to perform an accelerated movement. The accelerated movement of the development device 30 will now be described in detail.

The development device 30 can be moved to have the accelerated movement by using an actuator, such as a cam, devices, such as a rack and a pinion, resilience of a spring, or a pulling action due to driving force, for example. Alternatively, the above methods can be used in combination. In the accelerated movement of the present example described below, the development device 30 is pulled toward the photoconductor belt 11 by using pulling force generated by the driving force, and is stopped by a stopper.

Figure 9:
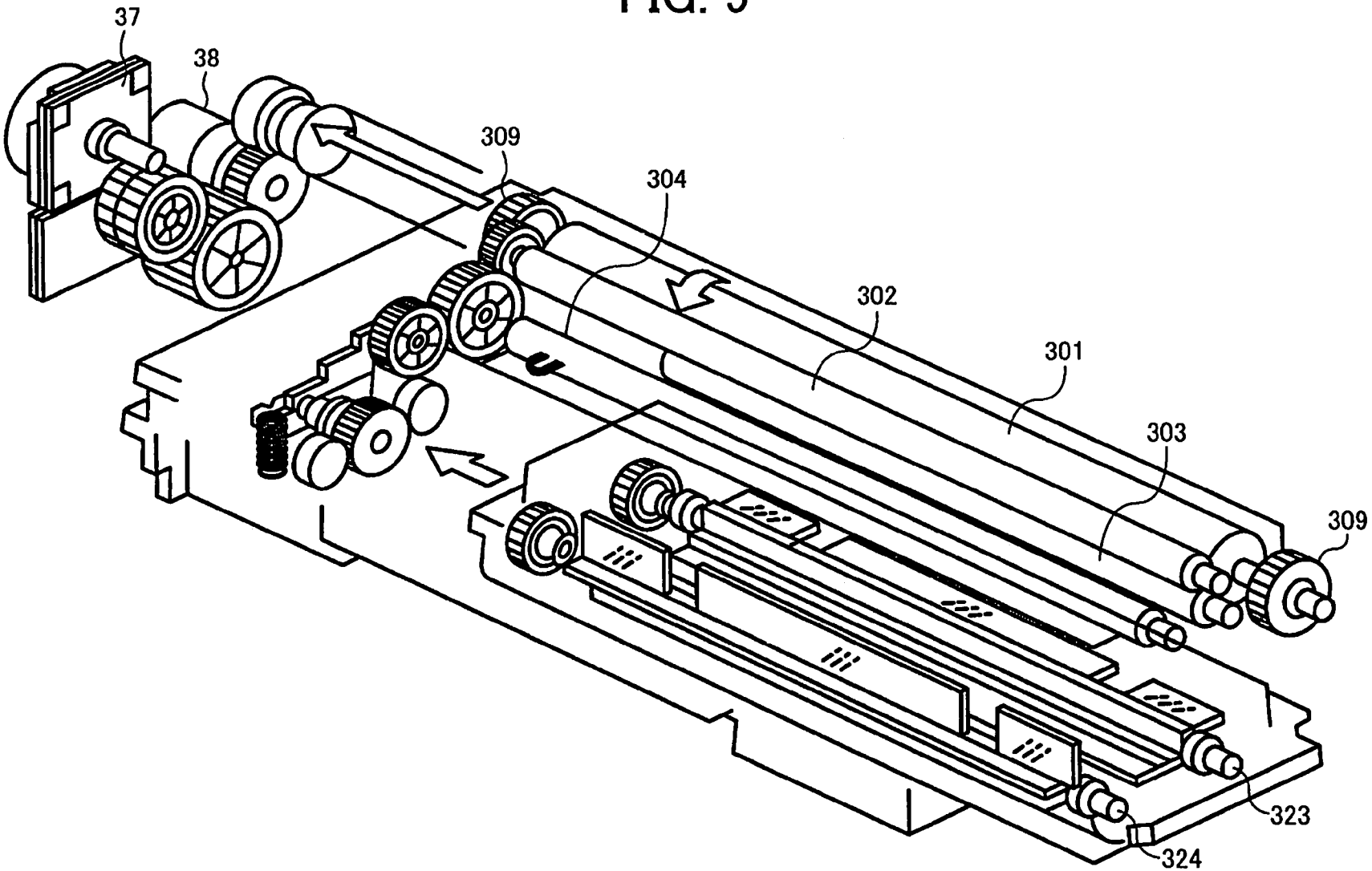
FIG. 9 is a schematic view illustrating a configuration of the development device illustrated in FIG. 1.

FIG. 9 is a schematic view illustrating a configuration of the development device 30.

In the development device 30, a development motor 37 is connected via a relay gear to a development clutch 38, a drive shaft (not illustrated but provided directly under the development sleeve 301) which is connected to the development clutch 38 and which rotates upon turn-on of the development clutch 38, a pair of development drive gears (not illustrated) fixed to a left end and a right end (i.e., a back-side end and a front-side end) of the drive shaft in the figure, and development sleeve drive gears 309 which engage with the pair of development drive gears and which are fixed to journals provided at opposite ends of the development sleeve 301. When the development motor 37 rotates and the development clutch 38 is tuned on at a predetermined timing, the drive shaft rotates to rotate the development drive gears attached to the drive shaft. The journals of the development sleeve 301 can move both in a direction toward the photoconductor belt 11 and in the opposite direction thereof. When the development sleeve drive gears 309 attached to the journals rotate in engagement with the development drive gears attached to the drive shaft, the development sleeve 301 and the entirety of the development device 30 are pulled toward the photoconductor belt 11.

After the development device 30 has moved by a predetermined distance, to reduce the likelihood or prevent the development device 30 from further penetrating into the photoconductor belt 11, the development device 30 is received by a stopper (not illustrated) and stopped at the position of the stopper, while the development sleeve 301 is rotating. A series of the motions described above form the accelerated movement applied to the development device 30. The accelerated movement includes an accelerated motion which occurs in the pulling operation and a decelerated motion which occurs when the development device 30 contacts the stopper. In the accelerated movement, the development device 30 is applied with the accelerated motion and the decelerated motion in the directions of supplying and discharging the toner. The accelerated movement can be controlled by adjusting timing, a rotation starting torque, spring force for initially setting the development device 30 at a rear position, a material forming the stopper, and so forth.

Figure 10A:
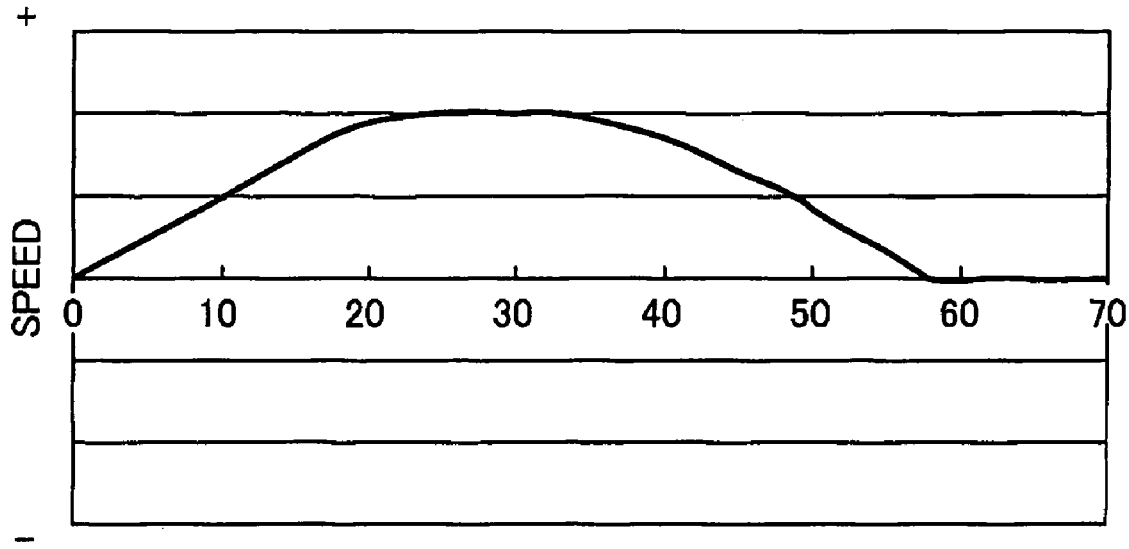
FIGS. 10A and 10B are graphs representing speeds and accelerations of the development device illustrated in FIG. 9 measured by a laser-Doppler velocimetry.
Figure 10B:
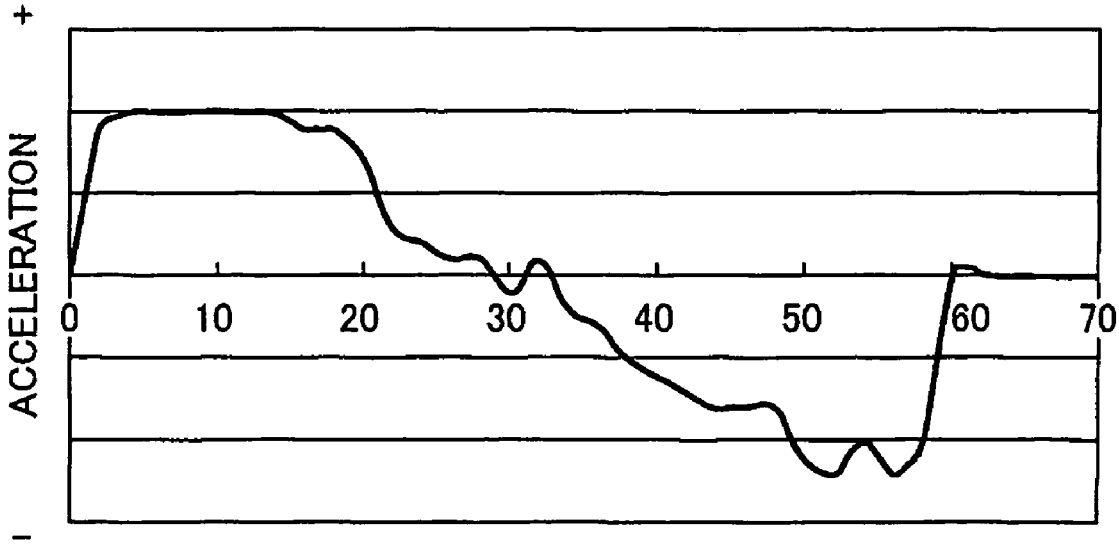

FIGS. 10A and 10B are graphs illustrating speeds and accelerations of the development device 30 as measured by a laser-Doppler velocimetry. In each of the graphs, a positive direction is a direction in which the development device 30 approaches the photoconductor belt 11.

As illustrated in FIG. 10A, the development device 30 first starts an accelerated motion in the positive direction, and continues to move in the positive direction at an approximately same speed. Finally, an accelerated motion in the negative direction takes place, and the speed of the development device 30 is reduced to substantially zero. That is, the development device 30 stays at one location, at which the development operation using the toner is performed to the photoconductor belt 11. In the above process, as illustrated in FIG. 10B, the acceleration of the development device 30 sequentially shifts from a positive value to a value of substantially zero and then to a negative value in the initial phase, the intermediate phase, and the final phase.

Due to the action of the acceleration and vibrations caused by the acceleration, in the development unit 31 or the toner cartridge 32, the aggregation between the toner particles in the less mobile state is broken, and spaces are formed between the toner particles. Thereby, the mobility of the entire toner is increased.

If the value of the acceleration is too small, the toner particles cannot be sufficiently broken apart. Conversely, if the value of the acceleration is too large, the image forming apparatus 1 receives vibrations and impacts, and thus such phenomena as vibration noise and banding caused by the vibrations of the drive system occur. The upper limit of the acceleration is determined by such factors as the structure, vibration absorbing ability, and noise reduction treatment of the image forming apparatus 1. In the configuration of the present exemplary embodiment, the upper limit of the acceleration is set to be approximately 10 meters per second squared. Meanwhile, the lower limit of the acceleration in the present configuration needs to be equal to or larger than approximately 1 $m/s^2$ to enhance the mobility of the toner. With the range of the acceleration thus set, even if the mobility of the toner is decreased after the image forming apparatus 1 has been left unused for a relatively long time or after the amount of the external additive for the toner (e.g., silica) has been reduced over time, for example, the toner flows in accordance with the movements of the control valves 34*b* and other components. Thus, deterioration in image quality caused by such factors as insufficient mixing of the toner and deterioration of the toner chargeability can be suppressed.

Further, it is effective to periodically apply the accelerated movement to the development device 30 during a time in which the development device 30 is not used.

Furthermore, if the accelerated movement of the development device 30 is performed at least before (immediately before) the development operation, flows of the toner can be effectively formed by the rotation of the first, second, and third conveying paddles 304, 323, and 324 and the movements of the control valves 34*b*.

The above-described exemplary embodiments are illustrative, and numerous additional modifications and variations are possible in light of the above teachings. For example, elements and/or features of different illustrative and exemplary embodiments herein may be combined with each other and/or substituted for each other within the scope of this disclosure. It is therefore to be understood that within the scope the disclosure of this patent specification may be practiced otherwise than as specifically described herein.

The invention claimed is:

1. An image forming apparatus, comprising:

an image carrying member;

a charging device configured to evenly charge a surface of the image carrying member;

an exposure device configured to write a latent image on the surface of the image carrying member;

a development device including a development unit configured to develop the latent image into a visible image, a toner cartridge laterally juxtaposed to and detachable from the development unit and configured to supply toner to the development unit, and a control mechanism configured to control supply of toner from the toner cartridge to the development unit and discharge of the toner from the development unit to the toner cartridge, the development device performing an accelerated movement at an acceleration of approximately 1 $m/s^2$ or more and below 10 $m/s^2$ in directions of supplying and discharging the toner for a predetermined time period;

a transfer device configured to transfer the visible image to a recording medium directly or via an intermediate transfer member;

a cleaning device configured to clean the toner remaining on the image carrying member; and a fixing device configured to fix the visible image on the recording medium.

2. The image forming apparatus as described in claim 1, wherein the accelerated movement of the development device takes place at least before a development operation.

3. The image forming apparatus as described in claim 1, wherein the accelerated movement of the development device includes a set of an accelerated motion and a decelerated motion and is performed at least once.

4. An image forming apparatus, comprising:

image carrying means for carrying thereon an image;

charging means for evenly charging a surface of the image carrying means;

exposure means for writing a latent image on the surface of the image carrying means;

a development device including development means for developing the latent image into a visible image, toner storing means for storing and supplying toner to the development means, and control means for controlling supply of toner from the toner storing means to the development means and discharge of the toner from the development means to the toner storing means, the development device performing an accelerated movement at an acceleration of approximately 1 $m/s^2$ or more and below 10 $m/s^2$ in directions of supplying and discharging the toner for a predetermined time period;

transfer means for transferring the visible image to a recording medium directly or via intermediate transfer means;

cleaning means for cleaning the toner remaining on the image carrying means; and fixing means for fixing the visible image on the recording medium.

5. The image forming apparatus as described in claim 4, wherein the accelerated movement of the development device takes place at least before a development operation.

6. The image forming apparatus as described in claim 4, wherein the accelerated movement of the development device includes a set of an accelerated motion and a decelerated motion and is performed at least once.

7. An image forming method, comprising:

forming a development device with a development unit, a toner cartridge, and a toner supply and discharge control mechanism;

evenly charging a surface of an image carrying member;

writing a latent image on the surface of the image carrying member;

supplying toner from the toner cartridge to the development unit;

performing an accelerated movement of the development device at an acceleration of approximately 1 $m/s^2$ or more and below 10 $m/s^2$ for a predetermined time period in directions of the supplying and discharging toner from the development unit to the toner cartridge;

causing the development unit to develop the latent image into a visible image;

transferring the visible image to a recording medium directly or via an intermediate transfer member;

cleaning the toner remaining on the image carrying member; and fixing the visible image on the recording medium.

8. The image forming method as described in claim 7, wherein the performing the accelerated movement of the development device takes place at least before the developing.

9. The image forming method as described in claim 7, wherein the performing the accelerated movement of the development device is performed at least once, the accelerated movement including a set of an accelerated motion and a decelerated motion.

* * * * *